US005533280A

United States Patent [19]

Halliday

[11] Patent Number: 5,533,280

[45] Date of Patent: Jul. 9, 1996

[54] FOOTWEAR WITH INTERCHANGEABLE COMPONENTS

[76] Inventor: David Halliday, 469 Myrtle Ave., Brooklyn, N.Y. 11205

[21] Appl. No.: 386,938

[22] Filed: Feb. 10, 1995

[51] Int. Cl.[6] ..... A43B 3/24

[52] U.S. Cl. ..... 36/101; 36/15; 36/100

[58] Field of Search ..... 36/100, 101, 15

[56] References Cited

U.S. PATENT DOCUMENTS

| | | | |
|---|---|---|---|
| 1,318,247 | 10/1919 | Victor | 36/15 |
| 4,343,057 | 8/1982 | Bensley | 36/101 X |
| 4,377,042 | 3/1983 | Bauer | 36/101 |
| 4,887,369 | 12/1989 | Bailey et al. | 36/101 |
| 4,974,344 | 12/1990 | Ching | 36/101 |

FOREIGN PATENT DOCUMENTS

| | | | |
|---|---|---|---|
| 1056745 | 3/1954 | France | 36/15 |
| 0146096 | 7/1954 | Sweden | 36/101 |

*Primary Examiner*—Paul T. Sewell

*Assistant Examiner*—Ted Kavanaugh

[57] ABSTRACT

A footwear with interchangeable components that includes a base footing supporter, an interchangeable middle sole, an interchangeable insole, an interchangeable base interlocker, an interchangeable ridge connector, and an interchangeable upper member. The interchangeable middle sole is removably mounted to the base footing supporter so that the interchangeable middle sole can be readily changed by user according to user preference. The interchangeable insole is removably mounted to the interchangeable middle sole so that the interchangeable insole can be readily changed by user according to user preference. The interchangeable base interlocker is removably mounted to the base footing supporter so that the interchangeable base interlocker can be readily changed by user accordingly to user preference. The interchangeable ridge connector is removably mounted to the interchangeable insole so that the interchangeable ridge connector can be readily changed by user according to user preference. And, the interchangeable upper member is removably mounted to the interchangeable base interlocker so that the interchangeable upper member can be readily changed by user according to user preference.

10 Claims, 2 Drawing Sheets

FOOTWEAR WITH INTERCHANGEABLE COMPONENTS

BACKGROUND OF THE INVENTION

1. Field of the Invention:

The present invention relates to footwear. More particularly, the present invention relates to footwear having interchangeable components such as sole, cushion, insole, and upper member.

2. Description of the Prior Art

In the field of footwear, wearers differ in individual tastes and physical requirements. Therefore there exists a need for people to customize their own footwear according to their individual needs. For example, individual persons prefer a wide range of styles and colors of footwear. Also, individual persons have unique physical characteristics and participate in different types of activities, which could cause footwear to wear in different places.

Due to these factors, many different styles of footwear have been developed based on the persons individual tastes and needs. These different styles still may not fit every person's needs and tastes. Therefore, it is desirable for a person to select a style of footwear he/she prefers and then customize the footwear to his/her characteristics and activities.

Numerous innovations for footwear having interchangeable components have been provided in the prior art that are described as follows. Even though these innovations may be suitable for the specific individual purposes to which they address, they differ from the present invention as hereinafter contrasted.

The U.S. Pat. No. 4,814,661 to Razlaff et al. discloses a shoe which may be used to measure and analyze the forces exerted by a wearer during normal activities. This patent differs from the present invention in that it does not have component parts which are interchangeable to suit the individual needs of the wearer.

U.S. Pat. Nos. 3,646,497 to Gillikin et al. and 4,219,946 to Baum et at. both disclose a shoe that has an interchangeable heel. This patent differs from the present invention because the heels are only interchangeable.

U.S. Pat. No. 3,983,642 to Liao et at. discloses a shoe with interchangeable uppers. This patent differs from the present invention because the uppers are only interchangeable.

U.S. Pat. No. 5,317,822 to Johnson et al. discloses an athletic shoe with an interchangeable sole. This patent differs from the present invention because the soles are only interchangeable and attached to the athletic shoe by VELCRO(TM) and interlocking devices.

U.S. Pat. No. 5,282,288 to Henson et. al. discloses an athletic shoe with permanently attached interchangeable sole inserts. This patent differs from the present invention because only the sole inserts are interchangeable and they are permanently attached.

Numerous innovations for footwear with interchangeable components have been provided in the prior art that are adapted to be used. Even though these innovations may be suitable for the specific individual purposes to which they address, they would not be suitable for the purposes of the present invention as heretofore described.

SUMMARY OF THE INVENTION

The present invention describes footwear with interchangeable components enabling the differently styled components to be assembled to suit the tastes of the individual user.

Each piece of footwear is constructed from components that can be assembled from a list of alternative designs. Dress shoes, running shoes and casual designs can be created from these alternative designs. The basic components are: the sole, insole, base footing, interlocker, ridge connector, cushioning and upper. The soles, base footing and interlockers are assembled in a manner that does not require adhesive. The cushioning and uppers selected to suit the application are held in place by the interlocker. The result of the invention is footwear that is custom made and easily repairable.

A piece of footwear is designed by a user selecting a sole, insole, cushion and upper from various options. The interlocker, base, footing and ridge connector are then automatically selected based on the user's choice. The components are then assembled by fitting them together. The resulting shoe should prove lighter in weight, more durable and easier to repair.

This invention enables users to custom design their own footwear according to their individual needs. This concept provides for flexibility in the styling by working around a basic architecture. Anyone who desires a quality shoo that does not currently exist should find this invention an ideal alternative.

Accordingly, it is an object of the present invention to provide footwear that would allow a user to custom design their own footwear according to their individual needs.

More particularly, it is an object of the present invention to provide footwear with interchangeable soles, insoles, cushions and uppers that are held together by an interlocking system.

In keeping with these objects, and with others which will become apparent hereinafter, one feature of the present invention resides, briefly stated, is that various styles of footwear can be achieved.

When the footwear with interchangeable components is designed in accordance with the present invention, the entire footwear can be assembled or dissembled in minutes.

In accordance with another feature of the present invention, no gluing is required for assembly.

Another feature of the present invention is that it is lighter than existing footwear.

Yet another feature of the present invention is that the insole footwear with interchangeable components can be designed to vary in flexible footwear with interchangeable components and cushioning composition.

Still another feature of the present invention is that it provides space to absorb impact plus response to foot movements simultaneously.

Yet still another feature of the present invention is that the individual components move independently in response to foot movement providing maximum comfort.

Still yet another feature of the present invention is that the interchangeable components have an interlocking system enabling a person to custom design their own footwear according to their individual needs.

Another feature of the present invention is that it has interchangeable and replaceable parts, thus, reducing the overall cost of having numerous shoes for different purposes such as specially designed soles to play tennis and other soles to play golf. The present invention can utilize the same upper pans of the shoe while interchanging the sole portions. Similarly, the upper portion of the shoe can be interchanged to vary color.

Yet another feature of the present invention is that the components fit together without the use of glue during assembly. Yet non-permanent adhesive may be utilized.

Still another feature of the present invention is that the shoes may have various styles, standards, and multiple interlocking parts.

Yet still another feature of the present invention is that the shoe is lighter than existing footwear and utilizes different engineered structuring to allow footwear parts to move independently in response to foot movement within, due to the non-permanent adhesive construction. Therefore, a single unit will yield maximum comfort.

Another feature of the present invention is that the interlocking component system allows space for impact and response to foot movements simultaneously.

Another feature of the present invention is that composite materials may be utilized individually and in combination during integration and manufacturing of the individual component pans.

Yet another feature of the present invention is that the entire footwear can be assembled, reassembled and disassembled in minutes which facilitates replacement of individual pans and requiring less space in luggage while traveling.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawing.

BRIEF LIST OF REFERENCE NUMERALS UTILIZED IN THE DRAWING

10-footwear with interchangeable components 10

12-upper member 12

14-base interlocker 14

14A-base interlocker upper member groove 14A

Figure 1B:
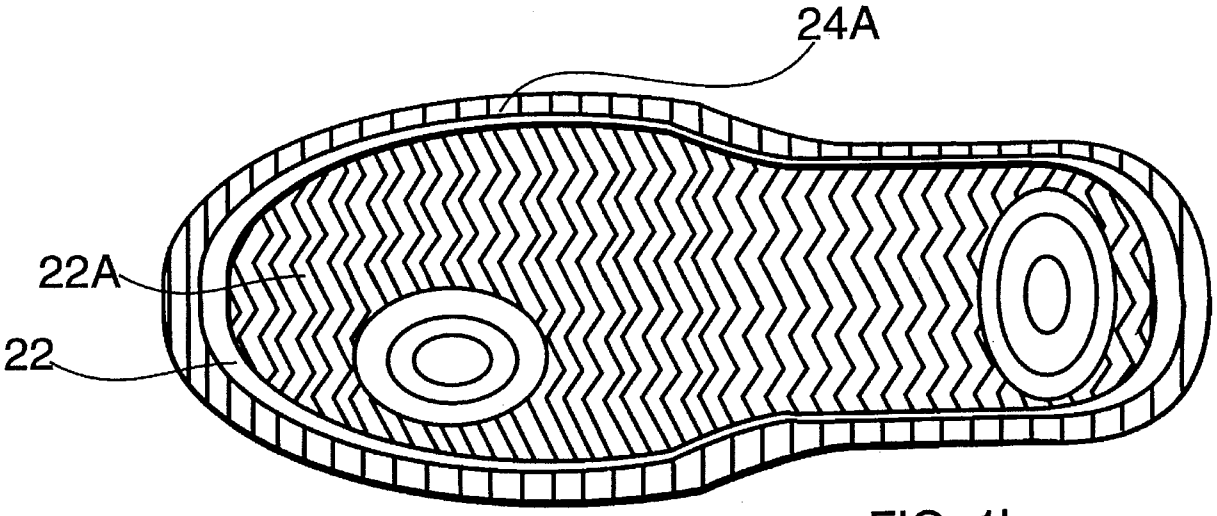
FIGURE 1B is a bottom view of the footwear with interchangeable components exhibiting the middle sole lower member connected to the middle sole inserted onto the inner perimeter of the outer sole lower member.

14B-base interlocker base footing supporter groove 14B

14C-base interlocker base footing supporter ridge 14C

14D-base interlocker angled ridge connector rest 14D

14E-base interlocker perpendicular ridge connector rest 14E

16-cushion 16

18-ridge connector 18

18A-ridge connector rear male member 18A

18B-ridge connector middle male member 18B

18C-ridge connector front male member 18C

20-insole 20

20A-insole ridge connector middle female member 20A

20B-insole ridge connector front female member 20B

22-middle sole 22

22A-middle sole lower member 22A

24-outer sole 24

24A-outer sole lower member 24A

26-base footing supporter 26

26A-base footing supporter base interlocker upper ridge 26A

26B-base footing supporter base interlocker groove 26B

26C-base footing supporter base interlocker lower ridge 26C

28-middle space 28

DETAILED DESCRIPTION OF THE PREFERRED EMBODIMENT

Figure 1A:
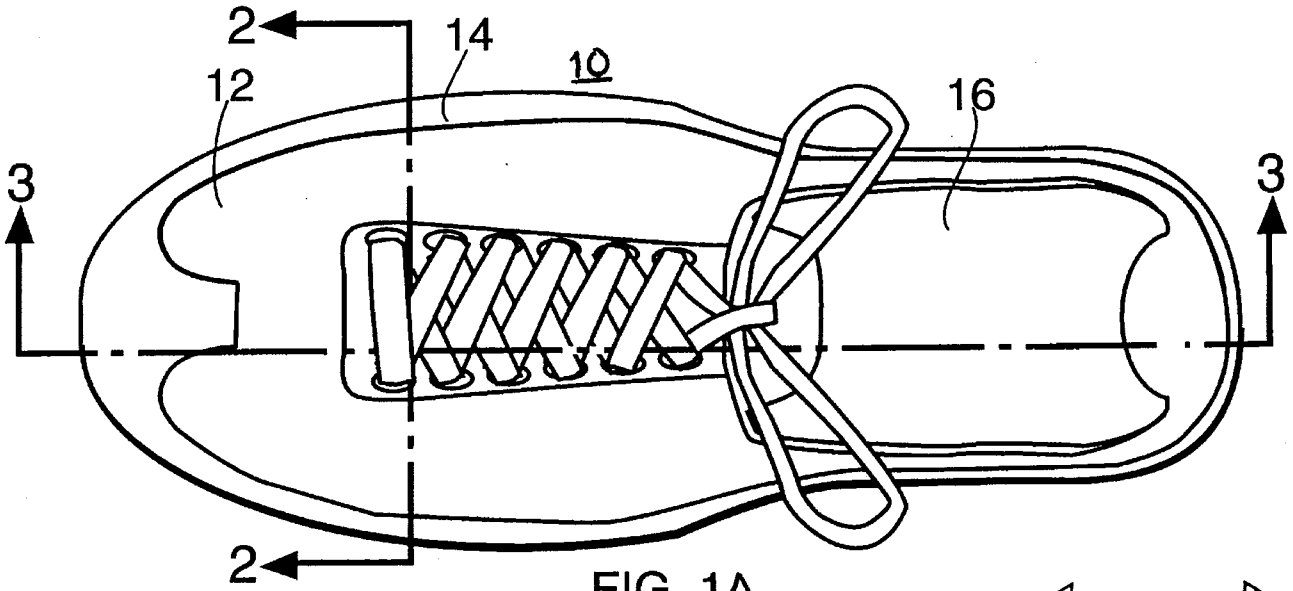
FIG. 1A is a top view of the footwear with interchangeable components exhibiting the upper member connected to the base interlocker containing the cushion therein.

Firstly, referring to FIG. 1A which is a top view of the footwear with interchangeable components 10 exhibiting an upper member 12 connected to a base interlocker 14 containing the cushion 16 therein. The upper member 12 is firmly attached by adhesive and/or a heat sealing process within a base interlocker groove 14A of the base interlocker 14. The cushion 16 is removably secured to a base interlocker angled ridge connector rest 14D and functions to provide a cushioning means for the user. The cushion 16 can be removed and substituted with another cushion 16 with different characteristics such as firmness, softness, thickening and/or absorbability.

Now referring to FIG. 1B which is a bottom view of the footwear with interchangeable components 10 exhibiting a middle sole lower member 22A connected to a middle sole 22 which is removably inserted into a base footing supporter base interlocker groove 26B resting on top of a base footing supporter base interlocker lower ridge 26C. The interchangeable middle sole lower member 22A and the middle sole 22 may be constructed from one composite component or from separate composite materials of varying densities. The function of the removability of the middle sole lower member 22A and the middle sole 22 member is to allow the user to vary the tread design, tread depth, tread hardness or softness, tread gripability to accommodate the user in different activities such as sports and varying environmental conditions. The outer sole lower member 24A, outer sole 24 and base footing support 26 may be constructed from one composite component or from separate composite materials of varying densities. The outer sole lower member 24A and the middle sole lower member 22A are interchangeable to allow similarity of both tread designs or to vary the different tread designs for maximum performance of the present invention.

Figure 2:
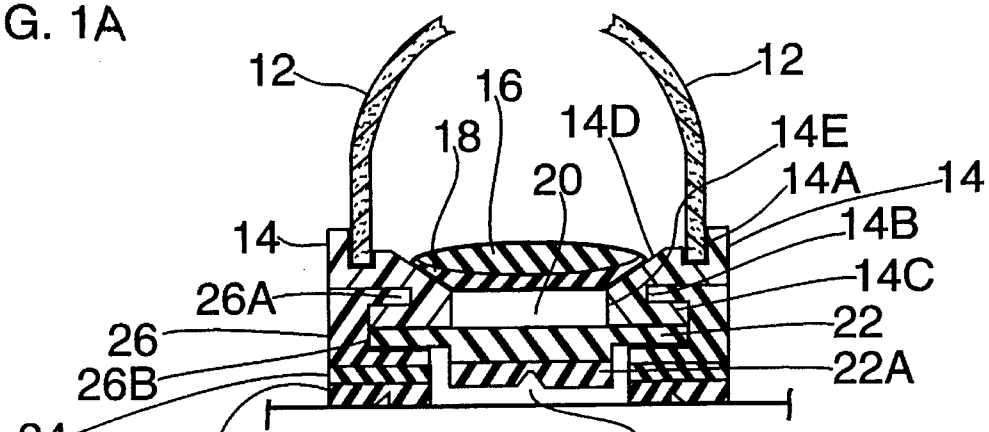
FIG. 2 is a lateral cross sectional view taken along line 2—2 in FIG. 1A of footwear with interchangeable components exhibiting the upper member attached to the interchangeable and interlocking components contained therein.

Referring to FIG. 2 which is a lateral cross sectional view taken along line 2—2 of footwear with interchangeable components 10 exhibiting the upper member 12 attached to the interchangeable and interlocking components contained therein exhibiting the following features: upper member 12; base interlocker 14; base interlocker upper member groove 14A; base interlocker base footing supporter groove 14B; base interlocker base footing supporter ridge 14C; base interlocker angled ridge connector rest 14D; base interlocker perpendicular ridge connector rest 14E; cushion 16; ridge connector 18; insole 20; middle sole 22; middle sole lower member 22A; outer sole 24; outer sole lower member 24A; base footing supporter 26; base footing supporter base interlocker upper ridge 26A; base footing supporter base interlocker groove 26B; base footing supporter base interlocker lower ridge 26C; and middle space 28. The outer sole lower member 24A functions as the outer tread which is in contact with the surface. The interchangeable outer sole lower member 24A may be of varying designs depending on the desired grip and surface for which it will be used. The outer sole lower member 24A and the outer sole 24 may be one composite or two separate components, of the same or differing material, firmly attached. The interchangibility allows the user to get different grip and support under varying conditions and activities. The outer sole 24 and the base footing supporter base interlocker lower ridge 26C may be one composite or two separate components, of the same or differing material, firmly attached.

The base footing supporter 26 includes a base footing supporter base interlocker upper ridge 26A, a base footing supporter base interlocker groove 26B, and a base footing supporter base interlocker lower ridge 26C. The base footing supporter 26 allows the middle sole 22 and the middle sole lower member 22A to be locked to the outer sole 24 at the base footing supporter base interlocker lower ridge 26C. The middle sole 22 and the middle sole lower member 22A serve as the center tread area.

The function of the removability of the middle sole lower member 22A and the middle sole 22 member is to allow the user to vary the tread design, tread depth, tread hardness or softness, tread gripability to accommodate the user in different activities such as sports and varying environmental conditions. The base footing supporter 26 also allows the base interlocker 14 to be locked to the outer sole 24 at the base footing supporter base interlocker upper ridge 26A. The base interlocker base footing supporter ridge 14C connects into the base footing supporter base interlocker groove 26B. The base footing supporter base interlocker upper ridge 26A connects into the base interlocker base footing supporter groove 14B. The interchangeable base interlocker 14 allows the upper member 12 to be attached to the base footing supporter 26 which will allow various upper members to be attached to a variety of soles depending on the users needs.

The base footing supporter base interlocker groove 26B is a cavity in which, during assembly, the middle sole 22 and base interlocker base footing supporter ridge 14C are placed. The insole 20 will attach to the middle sole 22 and will be positioned inside the base interlocker pedicular ridge connector rest 14E. The removable ridge connector 18 will attach to the insole 20 and will rest on the base interlocker angled ridge connector rest 14D. The cushion 16 will then rest on the ridge connector 18. The removable ridge connector 18 and cushion 16 will allow for various support, padding, and absorption. The upper member 12 is firmly attached by adhesive and/or by a heat sealing process within the base interlocker groove 14A of the base interlocker 14. The interchangeable upper member 12 maybe made from any of the materials used in footwear production, including but not limited to leather or cloth, and in numerous designs to allow the user a choice of style.

Figure 3:
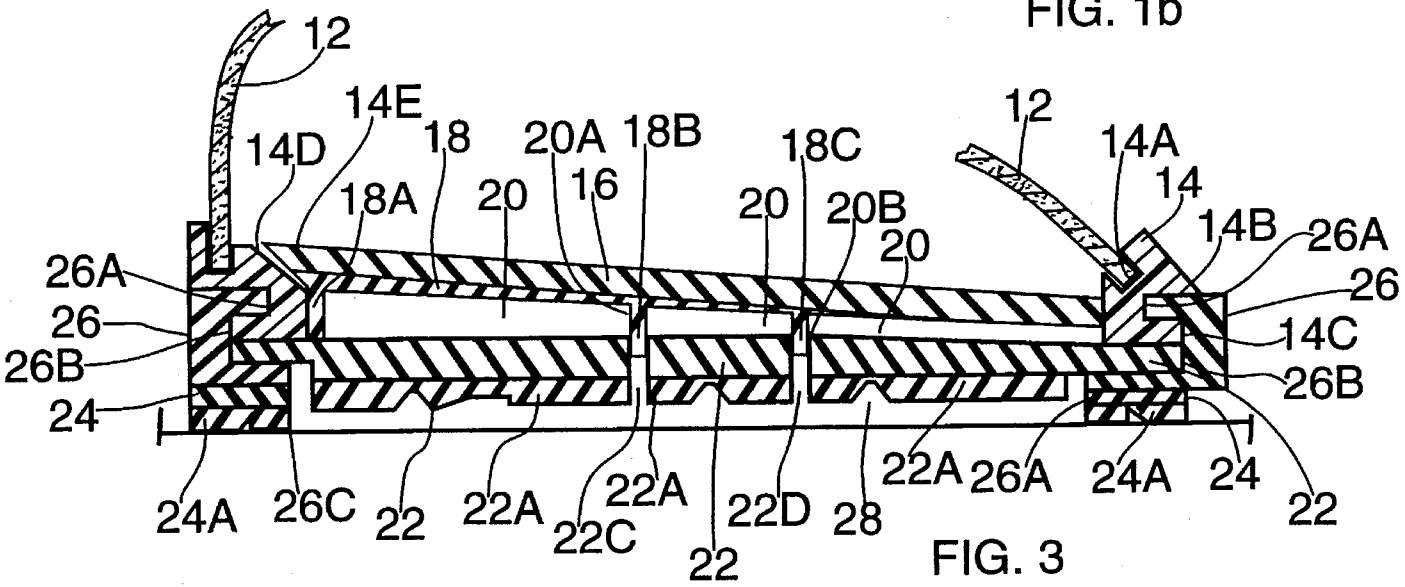
FIG. 3 is a longitudinal cross sectional view taken along line 3—3 of FIG. 1A of footwear with interchangeable components exhibiting the upper member attached to the interchangeable and interlocking components contained therein.

Referring to FIG. 3, which is a longitudinal cross sectional view taken along line 3—3 FIG. 1A of footwear with interchangeable components exhibiting the following features not shown in the other figures: a ridge connector male member 18A; a ridge connector middle male member 18B; a ridge connector front male member 18C; an insole ridge connector middle female member 20A; an insole ridge connector front female member 20B; a midsole ridge connector middle female member 22C; a midsole ridge connector front female member 22D. The midsole 22 has two ridges that extend laterally through it called the midsole ridge connector middle female member 22C and the midsole ridge connector front female member 22*d*. The insole also has two ridges that extends through it laterally called the insole ridge connector middle female member 20A and insole ridge connector front female member 20B. When the insole 20 is placed on top of the midsole 22 the two sets of ridges concentricly line up with each other respectively. The ridge connector 18 has three male members that extend downwardly and are called ridge connector rear male member 18A, ridge connector middle male member 18B and ridge connector front male member 18C. When the ridge connector 16 is placed on the insole 20 the rear ridge connector male member 18A fits between the rear edge of the insole 20 and the base interlocker pedicular ridge connector rest 14E. Also, the ridge connector middle male member 18B and the ridge connector front male member 18C fit in the concentric aligned ridges of the insole 20 and midsole 22. This male member and ridge arrangement serves to hold the insole 20 and midsole in place.

I claim:

1. A footwear with interchangeable components, comprising:

a) a base footing supporter;

b) an interchangeable middle sole being removably mounted to the base footing supporter so that the interchangeable middle sole can be readily changed by user according to user preference;

c) an interchangeable insole being removably mounted to the interchangeable middle sole so that the interchangeable insole can be readily changed by user according to user preference;

d) an interchangeable base interlocker being removably mounted to the base footing supporter so that the interchangeable base interlocker can be readily changed by user accordingly to user preference;

e) an interchangeable ridge connector being removably mounted to the interchangeable insole so that the interchangeable ridge connector can be readily changed by user according to user preference; and f) an interchangeable upper member being removably mounted to the interchangeable base interlocker so that the interchangeable upper member can be readily changed by user according to user preference.

2. The footwear as defined in claim 1, wherein the base footing supporter has a lower surface, a base interlocker upper ridge, and a lower ridge, the base interlocker upper ridge and the lower ridge define a base footing interlocker groove therebetween.

3. The footwear as defined in claim 2, wherein the interchangeable middle sole has an upper outwardly extending portion and a lower downwardly extending portion, the lower downwardly extending portion has a lower surface, the upper outwardly extending portion of the interchangeable middle sole is removably received within the base footing interlocker groove of the base footing supporter.

4. The footwear as defined in claim 3, wherein the interchangeable insole has an outer surface, an upper surface and a lower surface, the lower surface of the interchangeable insole is removably supported by the interchangeable middle sole.

5. The footwear as defined in claim 1; further comprising a cushion.

6. The footwear as defined in claim 5, wherein the interchangeable base interlocker has an inner surface, an upper portion and a lower portion, the upper portion has an upper member groove, the lower portion has a base interlocker base footing supporter groove and a base interlocker base footing supporter ridge.

7. The footwear as defined in claim 6, wherein the base interlocker is removably supported in the base footing supporter interlocker groove and removably looking the middle sole in the base footing supporter interlocking groove.

8. The footwear as defined in claim 7, wherein the base interlocker supporting ridge is disposed intermediate the base interlocker upper ridge of the base footing supporter and the upper portion of the middle sole.

9. The footwear as defined in claim 8, wherein the interchangeable ridge connector has an upper surface, a lower surface and an outer surface, the lower surface of the ridge connector is removably supported by the insole.

10. The footwear as defined in claim 1, wherein the interchangeable upper member has a lower edge that is removably secured within the interchangeable base interlocker.

* * * * *